US012419484B2

(12) United States Patent
Lee et al.

(10) Patent No.: US 12,419,484 B2
(45) Date of Patent: Sep. 23, 2025

(54) DISHWASHER

(71) Applicant: LG ELECTRONICS INC., Seoul (KR)

(72) Inventors: Jaegeun Lee, Seoul (KR); Jin Tae Kim, Seoul (KR); Seokhyun Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 267 days.

(21) Appl. No.: 18/018,456

(22) PCT Filed: Sep. 9, 2020

(86) PCT No.: PCT/KR2020/012202
§ 371 (c)(1),
(2) Date: Jan. 27, 2023

(87) PCT Pub. No.: WO2022/025339
PCT Pub. Date: Feb. 3, 2022

(65) Prior Publication Data

US 2023/0190070 A1 Jun. 22, 2023

(30) Foreign Application Priority Data

Jul. 28, 2020 (KR) ..... 10-2020-0093596

(51) Int. Cl.
*A47L 15/00* (2006.01)
*A47L 15/22* (2006.01)
(Continued)

(52) U.S. Cl.
CPC ..... *A47L 15/0028* (2013.01); *A47L 15/0049* (2013.01); *A47L 15/22* (2013.01);
(Continued)

(58) Field of Classification Search
None
See application file for complete search history.

(56) References Cited

U.S. PATENT DOCUMENTS

2012/0125366 A1* 5/2012 Beshears, Jr. ..... A47L 15/4463 222/25
2019/0290095 A1 9/2019 Wahlberg et al.

FOREIGN PATENT DOCUMENTS

DE 37 32 451 A1 4/1989
DE 10 2006 007 329 A1 8/2007
(Continued)

OTHER PUBLICATIONS

Kossira, "DE102014205266A1 English Machine Translation.pdf", Sep. 24, 2015—Machine translation from Espacenet.com.*

*Primary Examiner* — Levon J Shahinian
(74) *Attorney, Agent, or Firm* — Birch, Stewart, Kolasch & Birch, LLP

(57) ABSTRACT

The present disclosure relates to a dishwasher. The dishwasher according to an embodiment comprises: a tub having a washing room, in which an object to be washed is accommodated, formed therein; a nozzle which is arranged in the washing room and sprays washing water to the object to be washed, and includes a magnetic body at one end thereof; a coil which his formed to surround a region corresponding to a movable range of the nozzle, and through which an electric current flows according to the rotation of the nozzle; and a controller which controls an operation of the nozzle according to an operation command, and determines an operating status of the nozzle on the basis of a value of the voltage generated in the coil.

19 Claims, 10 Drawing Sheets

(51) Int. Cl.
*A47L 15/42* (2006.01)
*A47L 15/44* (2006.01)

(52) U.S. Cl.
CPC ..... *A47L 15/4257* (2013.01); *A47L 15/4274* (2013.01); *A47L 15/4278* (2013.01); *A47L 15/428* (2013.01); *A47L 15/4293* (2013.01); *A47L 15/44* (2013.01); *A47L 2401/24* (2013.01); *A47L 2401/30* (2013.01); *A47L 2501/26* (2013.01)

(56) References Cited

FOREIGN PATENT DOCUMENTS

| | | | |
|---|---|---|---|
| DE | 10 2014 205 266 | A1 | 9/2015 |
| EP | 0 053 231 | A1 | 6/1982 |
| EP | 0 534 213 | A1 | 3/1993 |
| EP | 1 743 566 | A2 | 1/2007 |
| JP | 2008-228813 | A | 10/2008 |
| KR | 20-1988-0021402 | U | 12/1988 |
| KR | 92-5952 | A | 4/1992 |
| KR | 10-1992-0007673 | B1 | 9/1992 |
| KR | 20-1998-021402 | U | 7/1998 |
| KR | 10-2006-0065858 | A | 6/2006 |

* cited by examiner

DISHWASHER

CROSS-REFERENCE TO RELATED APPLICATIONS

This application is the National Phase of PCT International Application No. PCT/KR2020/012202 filed on Sep. 9, 2020, which claims priority to Korean Patent Application No. 10-2020-0093596 filed in the Republic of Korea on Jul. 28, 2020, the entirety of which are hereby expressly incorporated by reference into the present application.

BACKGROUND

Technical Field

The present disclosure relates to a dishwasher.

Background Art

A dishwasher is a home appliance configured to remove foreign substances remaining on a washing target such as dishes or cooking utensils by spraying wash water to the washing target.

Generally, such a dishwasher may include a tub providing a washing space, a rack provided in the tub to accommodate dishes, a nozzle configured to spray wash water to the rack, a sump provided to store wash water, and a washing pump configured to supply the wash water stored in the sump to a spray arm.

The nozzle may spray wash water to a washing target, while rotating. However, the nozzle might not rotate smoothly due to causes such as the washing target is disposed within a rotation area of the nozzle or leakage of water in a flow path. An embodiment of a dishwasher capable of detecting rotation of a nozzle to solve the problem caused by the nozzle not rotating smoothly is disclosed in German Patent Registration No. 10-2006-007329.

The dishwasher may detect whether the nozzle rotates based on the result of detecting an alternating magnetic field generated by a magnetic material provided at each of both ends of the nozzle using a hall sensor. However, since the sensing area of hall sensor is limited, the hall sensor may not detect whether the nozzle is rotating when the position of the nozzle is changed. This can be described in detail, referring to FIG. 1.

FIG. 1 is a view showing a partial structure of a dishwasher according to the prior art.

Referring to FIG. 1, the dishwasher 100 may include a tub 110, a nozzle 120, a hall sensor 130, a controller 140 and a rack 150.

A user may move the rack 150 to at least one of an upper portion A, a middle portion B or a lower portion C based on the size of the washing target. At this time, the nozzle 120 may be connected to the rack 140 so that it may be moved vertically together as the rack 150 is moved.

When the rack 150 is positioned in the middle portion B, magnetic members 121 and 122 provided in both ends of the nozzle 120 may be disposed adjacent to the hall sensor 130. When the nozzle 120 is rotated, the hall sensor 130 may generate a voltage in response to a magnetic field changing based on the rotation of the magnetic materials 121 and 122.

However, when the rack 150 is positioned in the upper portion A or the lower portion C, the magnetic materials 121 and 122 provided in the both ends of the nozzle 120 may be disposed in positions far from the hall sensor 130. That is, the magnetic materials 121 and 122 may be disposed outside the sensing area of the hall sensor 130. Accordingly, even when the nozzle 120 is rotated, the sensor 130 may not generate a voltage in response to the magnetic field changing based on the rotation of the magnetic materials 121 and 122. In other words, the hall sensor 130 may not sense whether the nozzle 120 rotates regardless of the position of the nozzle 120. If a plurality of hall sensors 130 are coupled to the tub 110 to solve this, the production cost will increase due to the increase in the number of hall sensors 130.

Accordingly, there is a need to develop and invent a dishwasher 100 configured to detect whether the nozzle 120 rotates even at various positions.

DESCRIPTION OF DISCLOSURE

Technical Problems

Accordingly, an object of the present disclosure is to address the above-noted and other problems and to provide a dishwasher that may sense whether a nozzle rotates even at changed positions of the nozzle.

A further object of the present disclosure is to provide a dishwasher that may determine both a rotation direction and a rotation speed of a nozzle.

A still further object of the present disclosure is to provide a dishwasher that may sense an operation state of a nozzle and notify a user when a malfunction occurs.

Aspects according to the present disclosure are not limited to the above ones, and other aspects and advantages that are not mentioned above can be clearly understood from the following description and can be more clearly understood from the embodiments set forth herein.

Technical Solutions

A dishwasher according to the present disclosure may a nozzle disposed in the washing room and configured to spray wash water to the washing target, the nozzle comprising a magnetic material provided in one end thereof; a coil disposed to surround an area corresponding to a movable range of the nozzle and having an electric current flowing therein as the nozzle rotates; and a controller configured to control the operation of the nozzle based on an operation command and determine an operation state of the nozzle based on a voltage value generated in the coil.

Due to the structure described above, it may be detected whether the nozzle rotates even when the position of the nozzle is changed.

According to an embodiment of the present disclosure, a dishwasher may include a tub in which a washing room is formed to accommodate a washing target; a nozzle disposed in the washing room and configured to spray wash water to the washing target, the nozzle comprising a magnetic material provided in one end thereof; a coil disposed to surround an area corresponding to a movable range of the nozzle and having an electric current flowing therein as the nozzle rotates; and a controller configured to control the operation of the nozzle based on an operation command and determine an operation state of the nozzle based on a voltage value generated in the coil.

The dishwasher may further include a rack disposed in the washing room and configured to accommodate the washing room. The magnetic material may have a magnetic force corresponding to a distance between the nozzle and the rack.

In the embodiment, the coil may be provided as a wire wound around a structure.

Alternatively, in the embodiment, the coil may be provided as a pattern coil printed on a substrate.

In the embodiment, the dishwasher may further include a door coupled to one surface of the tub and configured to open and close the washing room; and a dispenser disposed in a predetermined portion of the door and configured to supply a washing detergent to the washing room. The coil may be disposed in consideration of the portion in which the dispenser is disposed.

The dishwasher may further include a securing bracket configured to secure the coil to the door.

The dishwasher may further include an amplifier circuit configured to amplify the voltage value generated in the coil by using one or more operational amplifiers and one or more passive elements, and output the amplified voltage value to the controller.

In the embodiment, when the voltage generated in the coil is 0V, the controller may determine that the operational state of the nozzle is a stop state, and when the voltage generated in the coil is not 0V, the controller may determine that the operational state of the nozzle is a rotation state.

When determining that the operation state of the nozzle is the stop state during the process of controlling the nozzle to rotate, the controller may transmit an abnormality notification to a user terminal or control an interface to output an abnormality notification.

The controller of the dishwasher according to the embodiment may determine a rotation direction and a rotation speed of the nozzle based on a change amount of voltage values generated in the coil.

When determining that the determined rotation direction of the nozzle is different a rotation direction included in the operation command or that the determined rotation speed of the nozzle is different from a rotation speed included in the operation command by a reference error or more, the controller of the dishwasher according to the embodiment may transmit an abnormality notification to the user terminal or control the interface to output an abnormality notification.

Advantageous Effect

The present disclosure has following advantageous effects. The dishwasher according to the present disclosure may determine the operation state of the nozzle based on the voltage value generated in the coil formed to surround the area corresponding to the movable range of the nozzle, thereby having an advantageous effect of detecting whether the nozzle rotates even when the position of the nozzle is changed.

In addition, the dishwater according to the present disclosure may determining both the rotation direction and the rotation speed of the nozzle, thereby having another advantageous effect of figuring out the operation state of the nozzle more accurately.

In addition, the dishwasher according to the present disclosure may output the abnormality notification when the nozzle malfunctions, thereby having a further advantageous effect of helping the user to respond and deal with the abnormality of the nozzle.

Specific effects are described along with the above-described effects in the section of Detailed description.

DETAILED DESCRIPTION OF EXEMPLARY EMBODIMENT

Figure 1:
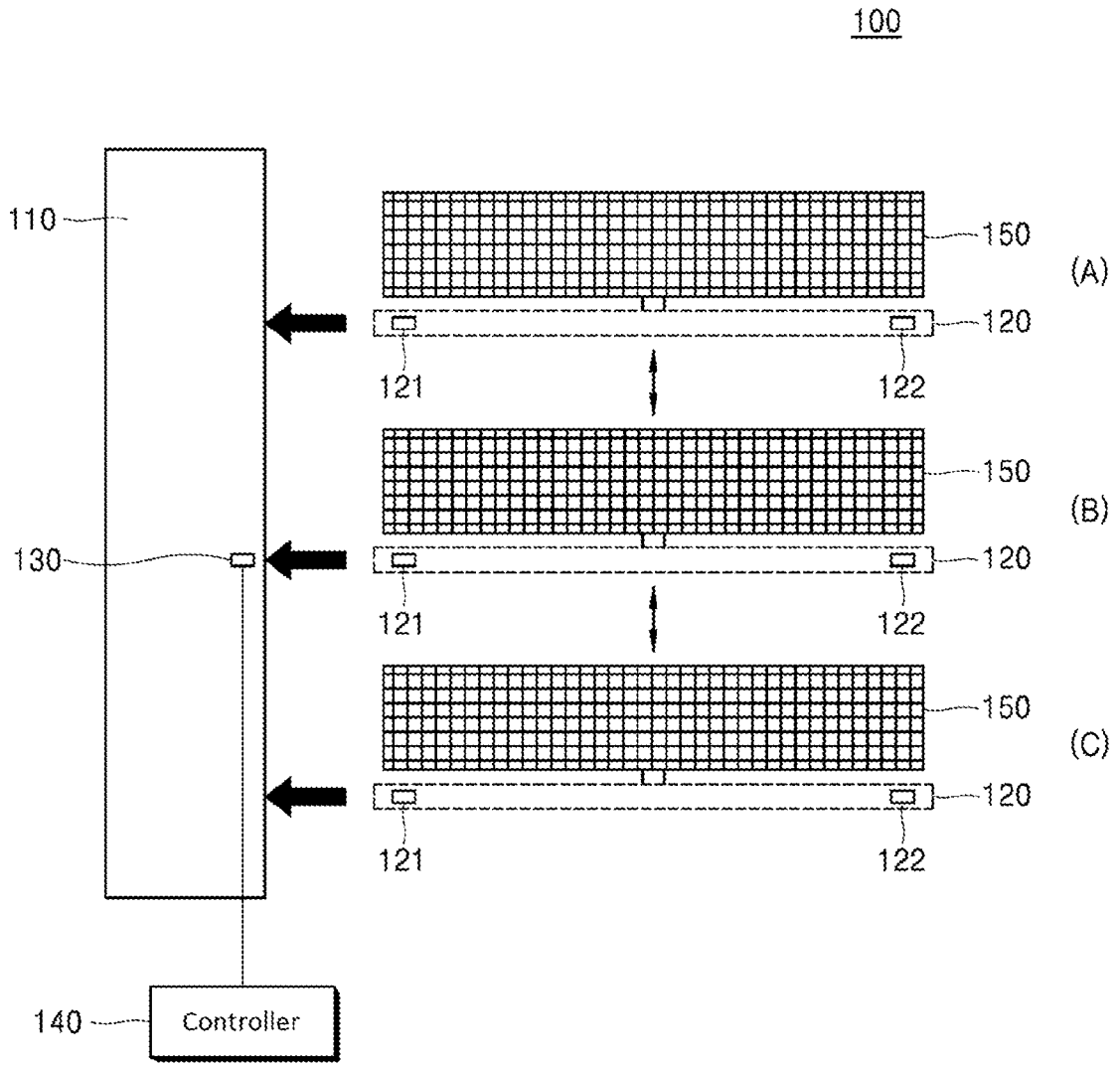
FIG. 1 is a view showing a partial structure of a dishwasher according to the prior art.

The above-described aspects, features and advantages are specifically described hereunder with reference to the accompanying drawings such that one having ordinary skill in the art to which the present disclosure pertains can easily implement the technical spirit of the disclosure. In the disclosure, detailed descriptions of known technologies in relation to the disclosure are omitted if they are deemed to make the gist of the disclosure unnecessarily vague. Below, preferred embodiments according to the disclosure are specifically described with reference to the accompanying drawings. In the drawings, identical reference numerals can denote identical or similar components.

The terms "first", "second" and the like are used herein only to distinguish one component from another component. Thus, the components should not be limited by the terms. Certainly, a first component can be a second component unless stated to the contrary.

Hereinafter, expressions of 'a component is provided or disposed in an upper or lower portion' may mean that the component is provided or disposed in contact with an upper surface or a lower surface. The present disclosure is not intended to limit that other elements are provided between the components and on the component or beneath the component.

It will be understood that when an element is referred to as being "connected with" or "coupled to" another element, the element can be directly connected with the other element or intervening elements may also be present. In contrast, when an element is referred to as being "directly connected with" another element, there are no intervening elements present.

Throughout the disclosure, each element may be singular or plural, unless stated to the contrary.

A singular representation may include a plural representation unless it represents a definitely different meaning from the context. Terms such as "include" or "has" are used herein and should be understood that they are intended to indicate an existence of several components, functions or steps, disclosed in the specification, and it is also understood that greater or fewer components, functions, or steps may likewise be utilized.

Hereinafter, a dishwasher according to several embodiment of the present disclosure will be described.

Figure 2:
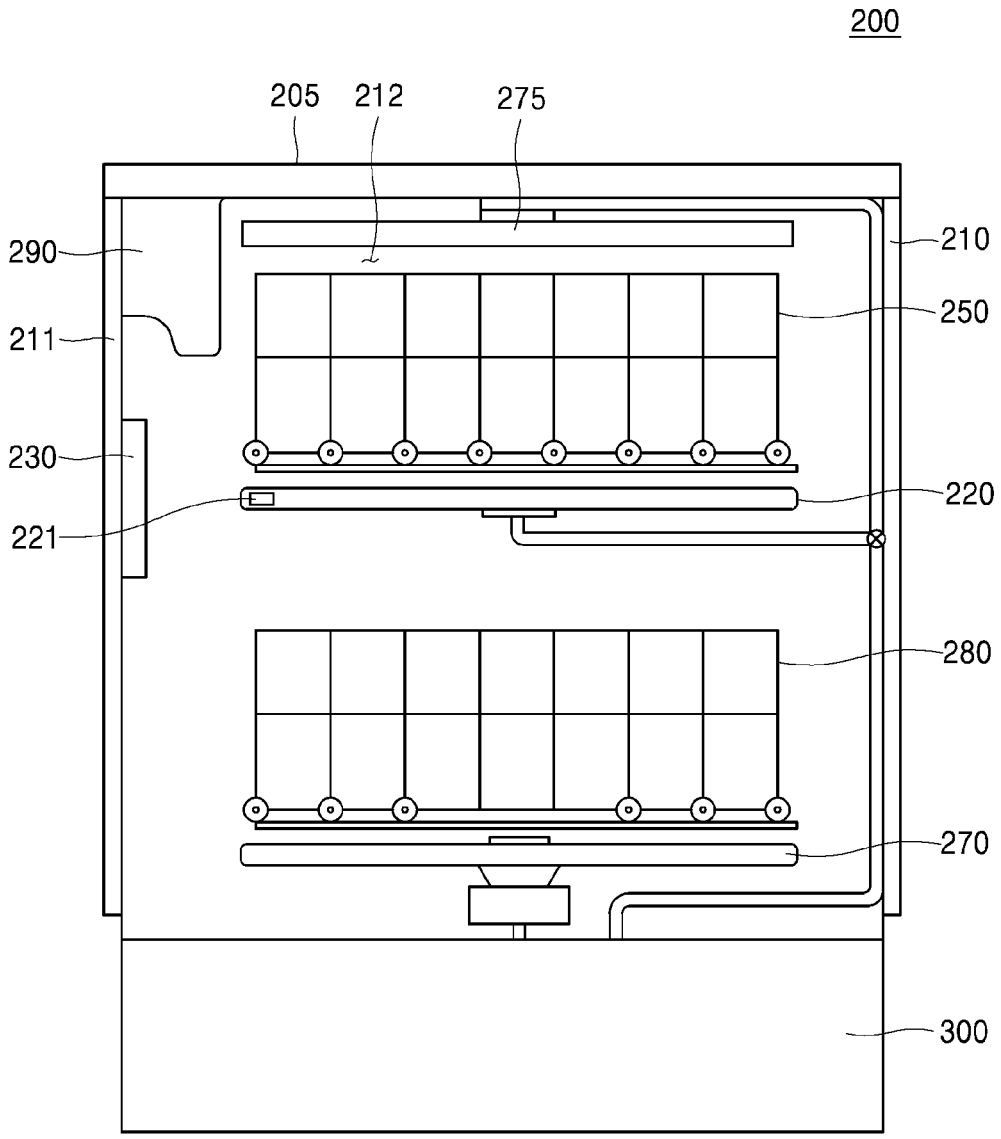
FIG. 2 is a view showing a dishwasher according to an embodiment of the present disclosure.

FIG. 2 is a view showing a dishwasher according to an embodiment of the present disclosure.

Referring to FIG. 2, the dishwasher 200 according to the embodiment may include a tub 210, an upper nozzle 220 and a coil 230. Although not shown in FIG. 2, the dishwasher 200 according to the embodiment of the present disclosure may include a controller 240 shown in FIGS. 3 and 8. The dishwasher 200 according to the embodiment may further include a case 205, a door 211, an upper rack 250, a top nozzle 275, a lower nozzle 270, a dispenser 290 and a wash water supplier 300.

The case 205 may define an exterior design of the dishwasher 200.

The tub 210 may be mounted in the case 205 and formed in a hexahedral shape with one open surface. Inside the tub 210 may be formed a washing room 212 configured to accommodate a washing target.

The door 211 may be coupled to the open surface of the tub 210 and configured to open and close the washing room 212. The door 211 may be opened and closed automatically, or may be opened and closed manually.

The dispenser 290 may be mounted in a predetermined portion adjacent to the door 211 and configured to supply a dishwashing detergent to the washing room 212.

The wash water supplier 300 may be mounted below the tub 210 and configured to supply wash water to one or more nozzles 220, 270 and 275. Such the wash water supplier 300 may include a sump for storing wash water, a washing pump configured to supply the wash water stored in the sump to the one or more nozzles 220, 270 275, a heater configured to heat the wash water inside the washing pump, a valve configured to adjust the flow of wash water, and a pipeline for wash water flow.

The one or more nozzles 220, 270 and 275 may be provided in the washing room 212 and configured to spray wash water toward a washing target. The one or more nozzles 220, 270 and 275 may include an upper nozzle 220 and a lower nozzle 270 spaced a preset distance apart from each other in a vertical direction of the washing room 212, and a top nozzle 324 disposed in an uppermost portion of the washing room 212.

The upper nozzle 220 may include a magnetic material 221 provided at one end thereof. The magnetic material 221 may be rotated together as the upper nozzle 220 is rotated to cause change in a magnetic field, thereby flowing an electric current in a coil 230 which will be described later. The magnetic material 221 according to an embodiment of the present disclosure may be a magnet.

One or more racks 250 and 280 may be disposed inside the washing room 212 and configured to accommodate a washing target. The one or more racks 250 and 280 may include an upper rack 250 disposed in an upper portion of the washing room 212 and a lower rack 280 disposed in a lower portion of the washing room 212.

The upper rack 250 may be connected to the upper nozzle 220 and the lower rack 280 may be connected to the lower nozzle 270.

The upper rack 250 and the lower rack 280 may be vertically spaced a preset distance apart from each other, and may slide to be discharged out through the open surface of the tub 210. The user may place a washing target on the discharged upper rack 250 and lower rack 280.

The upper rack 250 may be movable vertically. Accordingly, when the washing target stored in the upper rack 250 is caught on an upper of the tub 210 not to enter the washing room 212, the user may move the upper rack 250 downward within a predetermined movable range. In addition, when the washing target stored in the lower rack is caught on the upper rack 250 not to enter the washing room 212, the user may move the upper rack 250 upward within a predetermined movable range.

When the upper rack 250 is vertically moved, the upper nozzle 220 connected to the upper rack 250 may be vertically moved together with the upper rack 250. That is, the upper nozzle 220 may be moved upward or downward within the same movable range as the movable range of the upper rack 250.

The coil 230 may be formed to surround an area corresponding to the movable range of the upper nozzle 220. As the upper nozzle 220 is rotated, an electric current may flow in the coil 230.

The controller may be implemented to control the operation of the one or more nozzles 220, 270 and 275 through an operation command. At this time, the controller 240 may control the operation of the one or more nozzles 220, 270 and 275 by adjusting the amount of wash water supplied to the one or more nozzles 220, 270 and 275 through the operation command. The controller 240 may determine an operation state of the upper nozzle 220 based on a voltage value generated in the coil 230.

The controller 240 may be implemented by including at least one of ASICs (Application Specific Integrated Circuits), DSPs (Digital Signal Processors), DSPDs (Digital Signal Processing Devices), PLDs (Programmable Logic Devices), FPGAs (Field Programmable Gate Arrays), micro-controllers, or microprocessors.

The arrangement and structure of the coil 230 and the operation of the controller 240 will be described later, referring to FIGS. 3 to 10.

In the embodiment of FIG. 2, only the upper rack 250 and the upper nozzle 220 are vertically movable. In other embodiments, the lower rack 280 and the lower nozzle 270 may be also vertically movable. In this instance, a magnetic material may be provided in one end of the lower nozzle 270 and the coil may be additionally provided to surround the area corresponding to the movable range of the lower nozzle 270, so that it may be detected whether the lower nozzle 270 is rotated.

Specifically, the embodiments of the present disclosure may be applied when it needs to be detected whether the nozzle rotates regardless of the upper nozzle 220 or the lower nozzle 270. Accordingly, focusing on an embodiment in which the upper rack 250 and the upper nozzle 220 are movable vertically like the embodiment of FIG. 2, the arrangement of the coil 230, the structure of the coil 230 and the operation of the controller 240 will be described, but the scope of embodiments is not limited that the nozzle and the rack are positioned in the upper portion.

Figure 3:
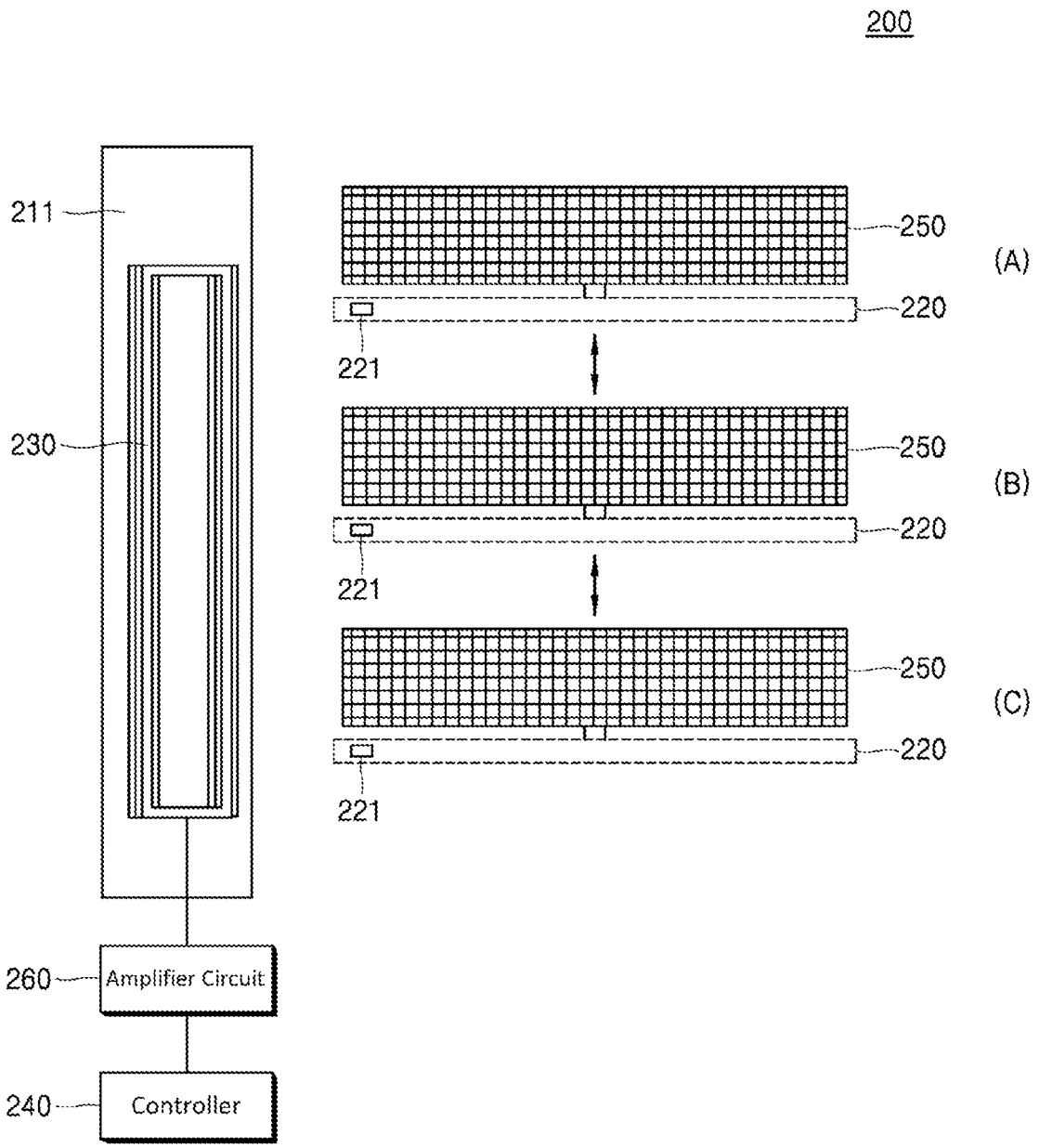
FIG. 3 is a view showing a partial structure of a dishwasher according to an embodiment of the present disclosure.

FIG. 3 is a view showing a partial structure of a dishwasher according to an embodiment of the present disclosure.

Referring to FIG. 3, the nozzle 220 and the rack 250 may be movable upward and downward in a predetermined movable range. Specifically, the nozzle 220 and the rack 250 may be movable upward and downward within the movable range bordered on an upper end A or a lower end C. Accordingly, the nozzle 220 and the rack 250 may be positioned between the upper end A and the lower end C by the user.

The nozzle 220 may include a magnetic material 221 that generates a magnetic field. The magnetic material 221 may have a magnetic force and the magnetic material 221 according to an embodiment of the present disclosure may be a magnet.

The magnetic material 221 may have a magnetic force corresponding to the separation distance between the nozzle 220 and the rack 250. The rack 250 may be formed of metal that can be pulled by the magnetic force. Accordingly, the magnetic material 221 may have the magnetic force having a size proportional to the separation distance between the nozzle 220 and the rack 250 in order to generate no attractive force between the nozzle 220 and the rack 250.

The coil may be formed to surround an area corresponding to the movable range of the nozzle 220. Specifically, a line extending along the longitudinal direction of the nozzle 220 may pass through the coil 230. Accordingly, the coil may be affected by the magnetic field generated by the magnetic material 221 formed in one end of the nozzle 220, even when the nozzle 220 is located in any positions between the upper end A and the lower end C.

Figure 4:
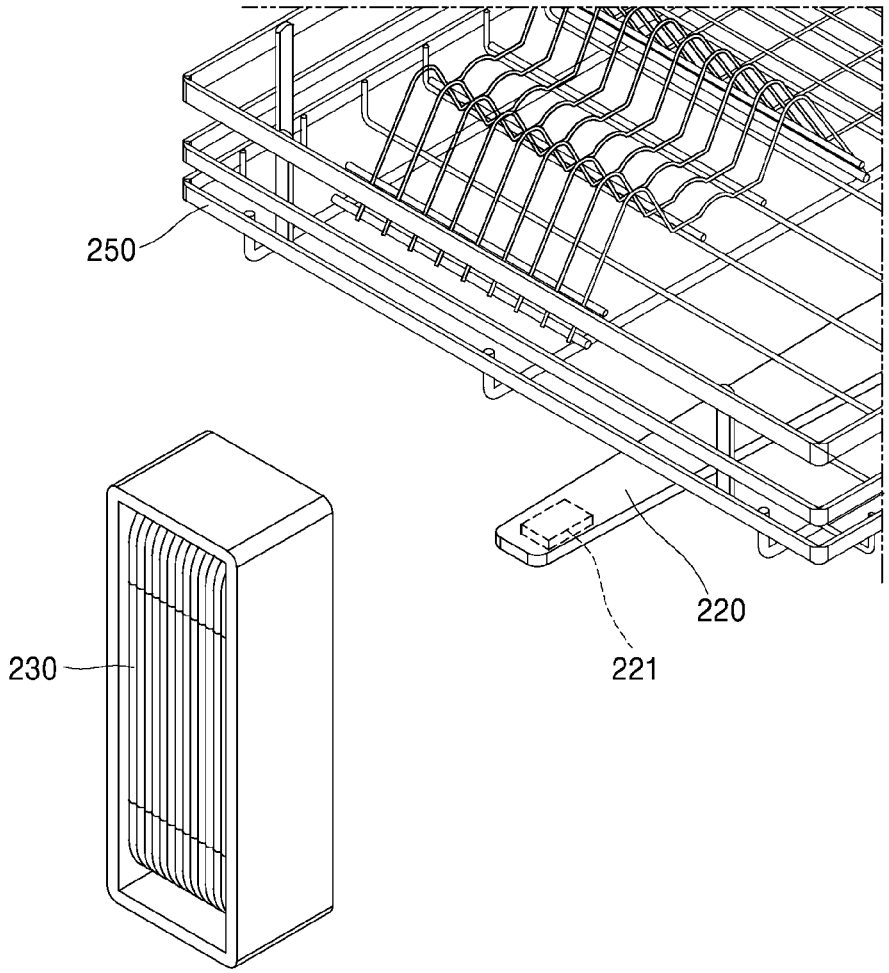
FIG. 4 is a view showing a structure of a coil provided in a dishwasher according to an embodiment of the present disclosure.
Figure 5:
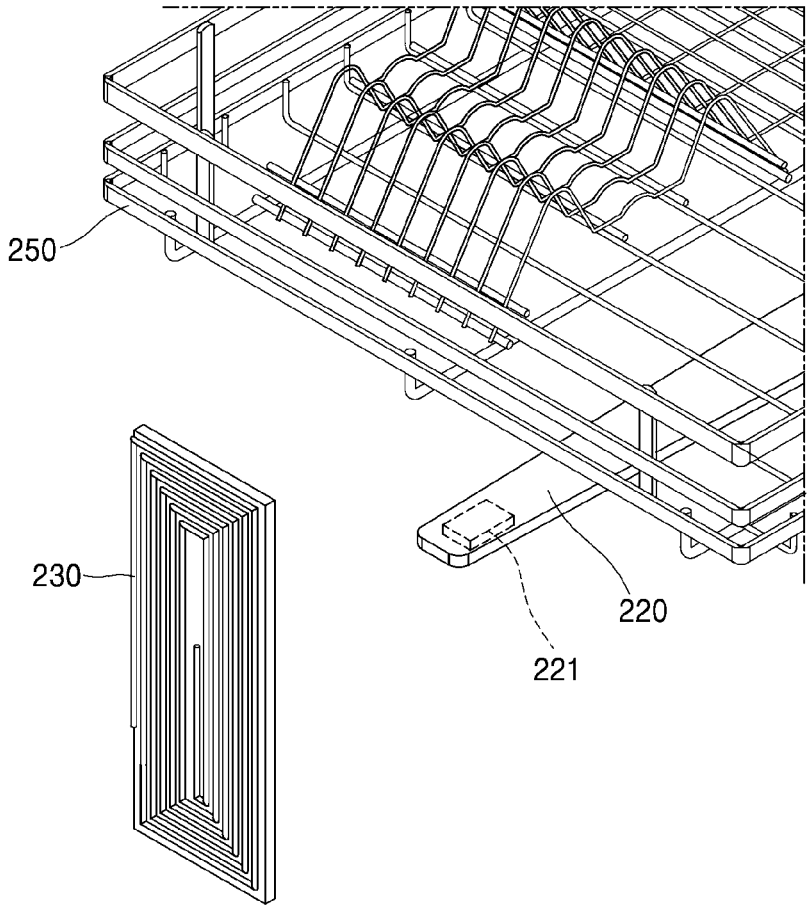
FIG. 5 is a view showing a structure of a coil provided in a dishwasher according to another embodiment of the present disclosure.

The coil 230 may be a wire wound around a structure or a patterned coil printed on a substrate, which is shown in FIGS. 4 and 5.

FIG. 4 is a view showing a structure of a coil provided in a dishwasher according to an embodiment of the present disclosure.

Referring to FIG. 4, the structure of the coil 230 provided in the dishwasher 200 according to an embodiment of the present disclosure is shown. The coil 230 may be provided as a wire wound inside a rectangular-shaped structure as described above.

When the coil 230 is provided as the wire wound inside the structure, the coil 230 may be more affected by the magnetic field generated by the magnetic material 221 formed in the one end of the nozzle 220. Since the coil 230 is provided as the wire wound inside the structure, the sensing function of the coil 230 may be improved.

FIG. 5 is a view showing a structure of a coil provided in a dishwasher according to another embodiment of the present disclosure.

Referring to FIG. 5, the structure of the coil 230 provided in the dishwasher 200 according to another embodiment of the present disclosure is shown. The coil 230 may be provided as a pattern coil printed on a substrate.

When the coil 230 is the pattern coil printed on the substrate, the cost required for the production of the coil 230 may be reduced, compared to the coil provided as the wire wound inside the structure. In addition, the space occupied inside the dishwasher 200 may be reduced, compared to the coil 230 provided as the wire wound inside the structure. Accordingly, the coil 230 may be provided in the form of the pattern coil printed on the substrate, thereby having an advantage in terms of cost and space security.

Referring back to FIG. 3, the coil 230 may be disposed outside the path in which the magnetic material 221 moves as the nozzle 220 rotates. In an embodiment of the present disclosure, the nozzle 220 may be configured to spray wash water while rotating in a clockwise or counter-clockwise direction. At this time, the magnetic material 221 may rotate in the clockwise or counter-clockwise direction together with the nozzle 220. Accordingly, the coil 230 may be disposed outside the path along the rotation of the magnetic material 221 as the nozzle 220 rotates, so that an induced current may flow according to change in the magnetic field generated by the rotation of the magnetic material 221.

At this time, the coil 230 may be disposed in consideration of the area in which the dispenser 290 is provided in the door 211, which will be described in detail, referring to FIG. 6.

Figure 6:
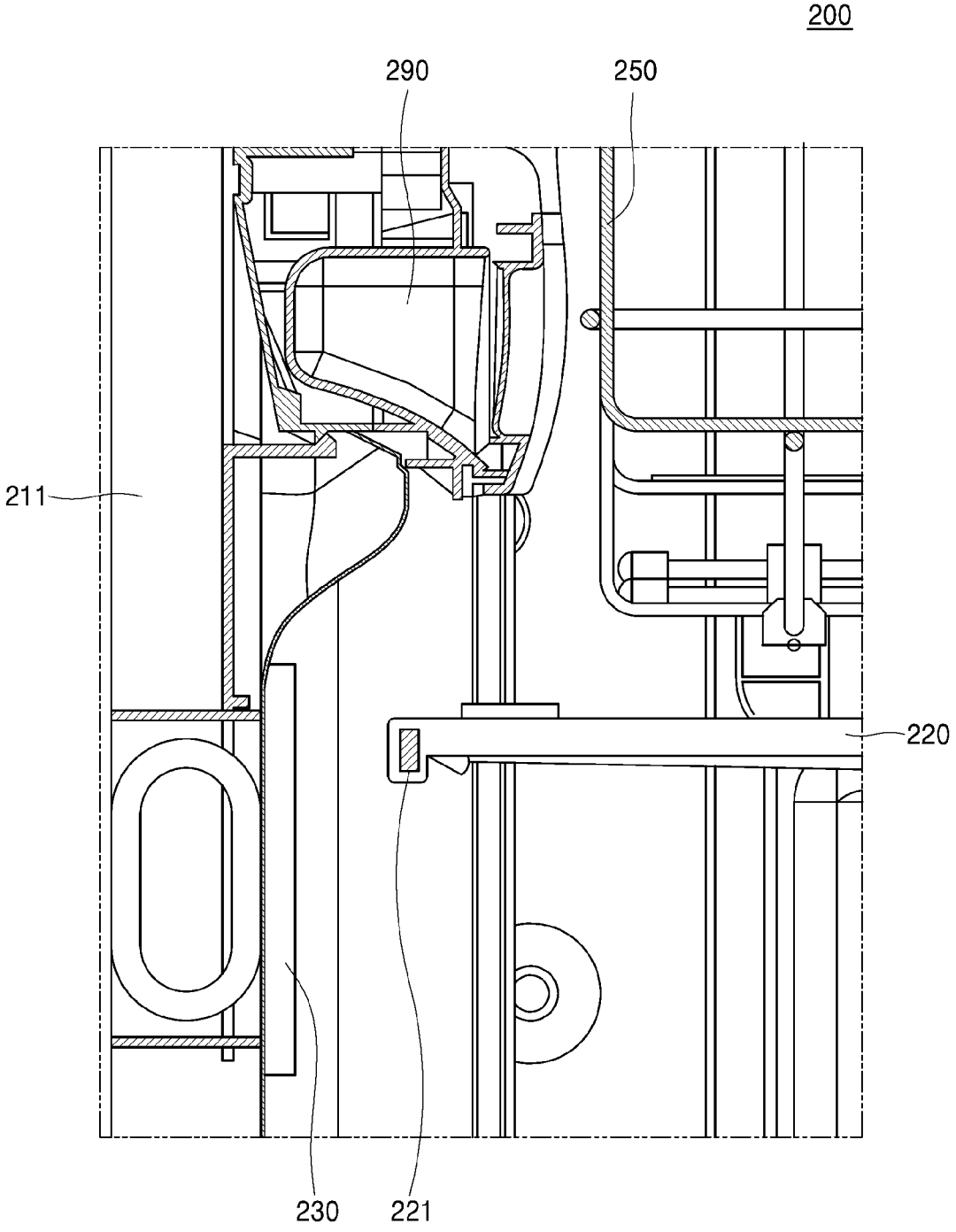
FIG. 6 is a view showing arrangement of a nozzle and a coil that are provided in a dishwasher according to an embodiment of the present disclosure.

FIG. 6 is a view showing arrangement of a nozzle and a coil that are provided in a dishwasher according to an embodiment of the present disclosure.

Referring to FIG. 6, a sectional view of an area having the nozzle 220, the coil 230, the rack 250 and the dispenser 290 provided in the dishwasher 200 may be shown.

The coil 230 may be disposed on a surface of the door 211 toward the washing room 212, that is, an inner surface of the door 211. In this instance, the coil 230 may be disposed on the inner surface of the door 211 and the arrangement of the coil 230 may be performed, considering the position and the movable range of the nozzle 220.

More specifically, in order to detect the magnetic force generated by the magnetic material 221 provided in the nozzle 220, the coil 230 may be arranged in an area in which the distance between the nozzle 220 and the magnetic material 221 is the shortest on the inner surface of the door 211.

In the embodiment of the present disclosure, the dispenser 290 may be arranged on the inner surface of the door 211. In general, the dispenser 290 is disposed on an upper end of the inner surface of the door 211 to facilitate the user's washing detergent introduction. Accordingly, the coil 230 may be arranged in consideration of the area in which the dispenser 290 is disposed on the door 211. As one example, when the dispenser 290 is provide in an upper end area of the inner surface of the door 211, the coil 230 may be disposed to surround all of the movable range of the nozzle at s position where the distance between the nozzle 220 and the magnetic material 221 is the shortest below the position of the dispenser 290.

Such the coil 230 may be coupled to the door 211 through a securing bracket 231, which will be described in detail, referring to FIG. 7.

Figure 7:
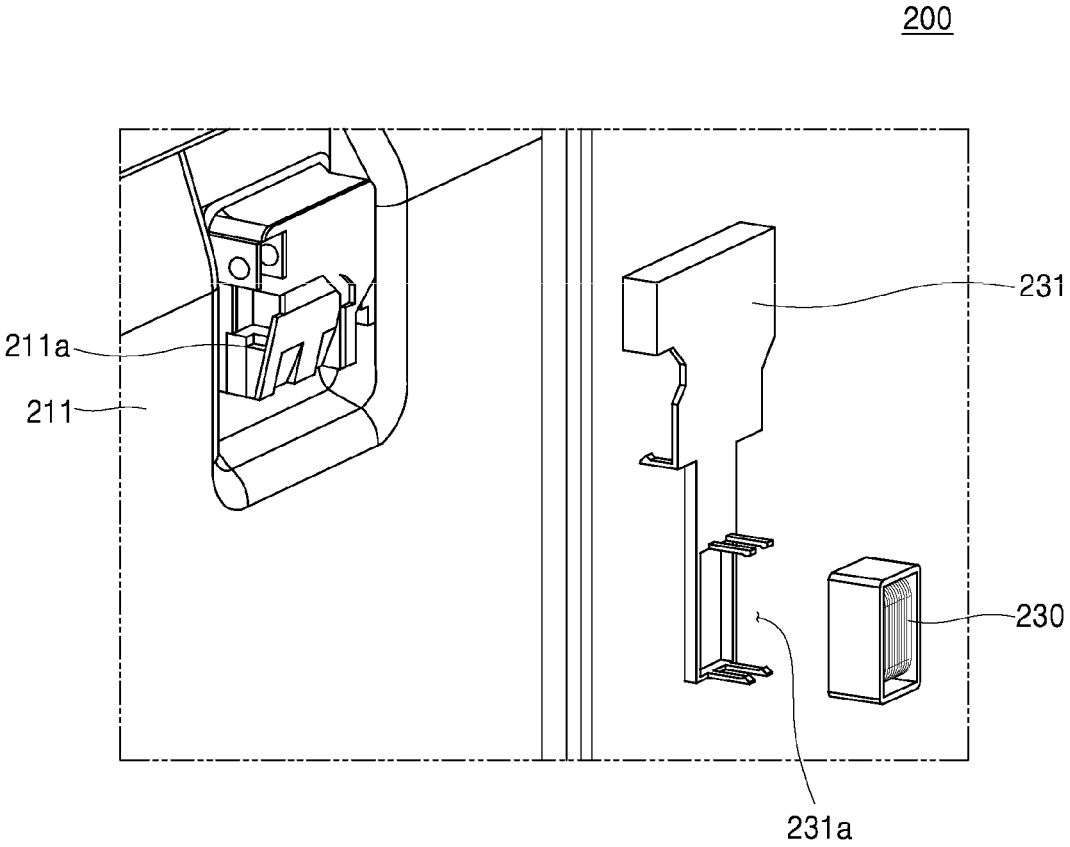
FIG. 7 is a view showing a specific structure in which a coil and a nozzle that are provided in a dishwasher according to an embodiment of the present disclosure.

FIG. 7 is a view showing a specific structure in which a coil and a nozzle that are provided in a dishwasher according to an embodiment of the present disclosure;

Referring to FIG. 7, the coil 230 may be coupled to the door 211 through the securing bracket 231. The securing bracket 231 may include a coupling portion 231 for stably coupling the coil 230 to the door 211. In addition, the door 211 may include a bracket coupling portion 211*a* coupled to the securing bracket 231.

Since the securing bracket 231 is used to couple the coil 230 to the door 211 by using, the coupling between the coil 230 and the door 211 may be performed more stable.

However, the embodiment shown in FIG. 7 only shows an example of the securing bracket 231 for coupling the coil 230, and the securing bracket 231 may be formed in a different shape that can facilitate stable coupling between the coil 230 and the door 211.

Referring back to FIG. 3, the coil 230 may be affected by the magnetic field generated by the magnetic material 221 formed in one end of the nozzle 220. In other words, as the nozzle 220 rotates, the position of the magnetic material 221 may move and the size of the magnetic field passing through the coil 230 may then change. Accordingly, an induced current may flow in the coil 230 and a potential difference may be generated in both ends of the coil 230 due to the induced current flowing in the coil 230.

In this instance, the controller 240 may detect the potential difference generated in both ends of the coil 230 and determine the operation state of the nozzle 220 based on voltage values generated in both ends of the coil 230.

The voltage values generated in both ends of the coil 230 may be amplified by an amplifier circuit 260 and then sensed by the controller 240. The detained structure of the amplifier circuit 260 will be described referring to FIG. 8.

Figure 8:
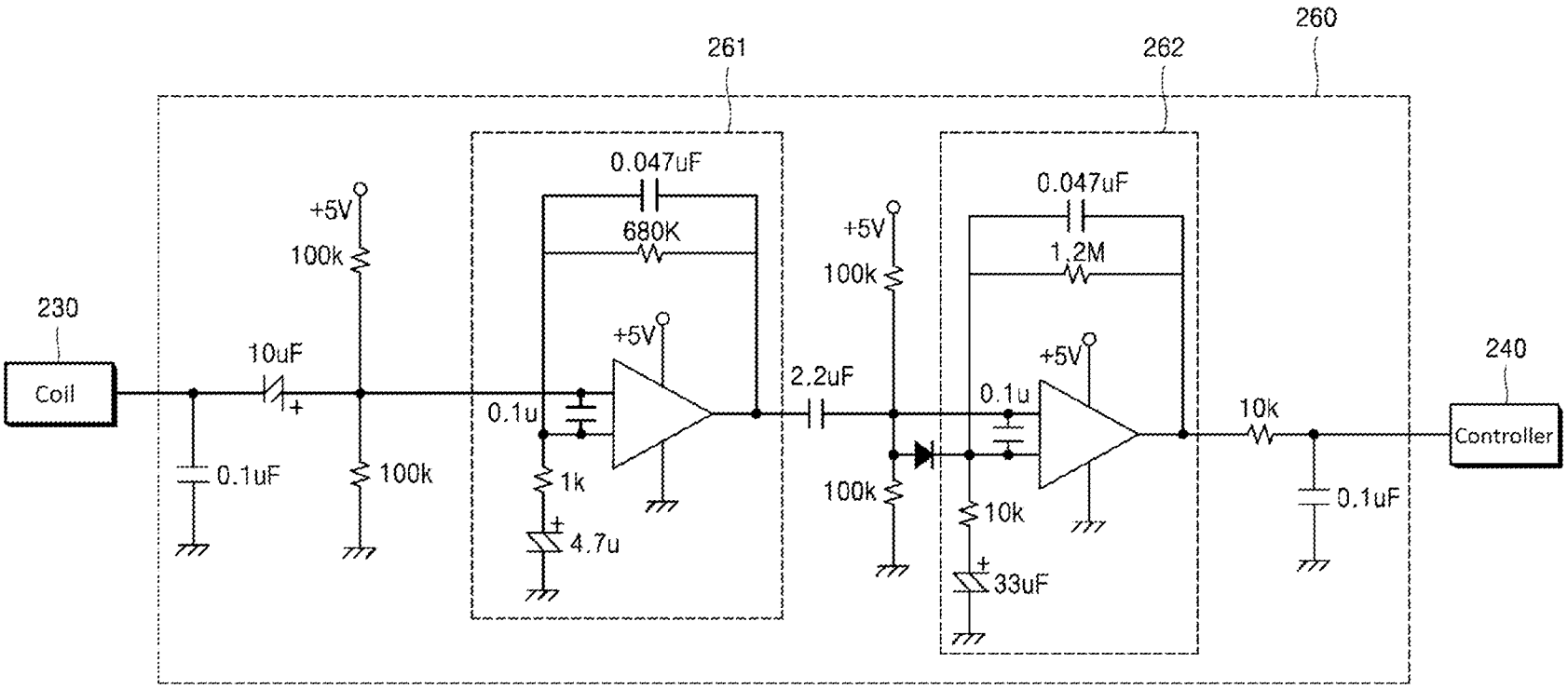
FIG. 8 is a view showing in detail an amplification circuit of a dishwasher according to an embodiment of the present disclosure.

FIG. 8 is a view showing in detail an amplification circuit of a dishwasher according to an embodiment of the present disclosure.

Referring to FIG. 8, the amplifier circuit 260 may be disposed between the coil 230 and the controller 240. That is, the amplifier circuit 260 may be configured to amplify the voltage values generated in both ends of the coil 230 and output the amplified values to the controller 240.

The amplifier circuit 260 may include one or more operational amplifiers and one or more passive elements to amplify the voltage value generated in the coil, and may output the amplified voltage value to the controller 240.

In one embodiment of the present disclosure, the amplifier circuit 260 may include a first amplifier 261 and a second amplifier 262. Each of the first amplifier 261 and the second amplifier 262 may include a passive element (e.g., a capacitor and a resistor) and an operational amplifier. At this time, the ratio amplified by the first amplifier 261 and the second amplifier 262 may be adjusted by changing values of the passive elements.

The voltage value generated in the coil 230 may be amplified by the amplifier circuit 260 and the amplified value may be output to the controller 250 so that the controller 240 may smoothly sense the voltage value generated in the coil 230.

However, the embodiment of FIG. 8 shows only one example of the amplifier circuit 260. The amplifier circuit 260 may be one of the conventional circuits used to amplify voltage values.

Referring back to FIG. 3, the controller 240 may be configured to determine the operation state of the nozzle 220 based on the voltage value generated in the coil 230. If the determined operational state of the nozzle 220 is different from an operation state of the nozzle 220 included in an operation command, the controller 240 may notify the user of this.

More specifically, when the voltage value generated in the coil 230 is 0V, the controller 240 may determine that the operation state of the nozzle 220 is a stop state. Unless the voltage value generated in the coil 230 is 0V, the controller 240 may determine that the operation state of the nozzle is a rotation state.

When the controller 240 determines the operation state of the nozzle 220 as the stop state while controlling the nozzle 220 to rotate based on the operation command, the controller 240 may transmit an abnormality notification to a user terminal or control an interface to output an abnormality notification. As such, the controller 240 may output the abnormality notification when the nozzle 220 malfunctions, so that the user can more quickly respond to and deal with the malfunction of the nozzle 220.

The controller 240 may be configured to determine the rotation direction and the rotation speed of the nozzle 220 based on the amount of change in the voltages value generated in the coil 230, which will be described in detail below, referring to FIGS. 9 and 10.

Figure 9:
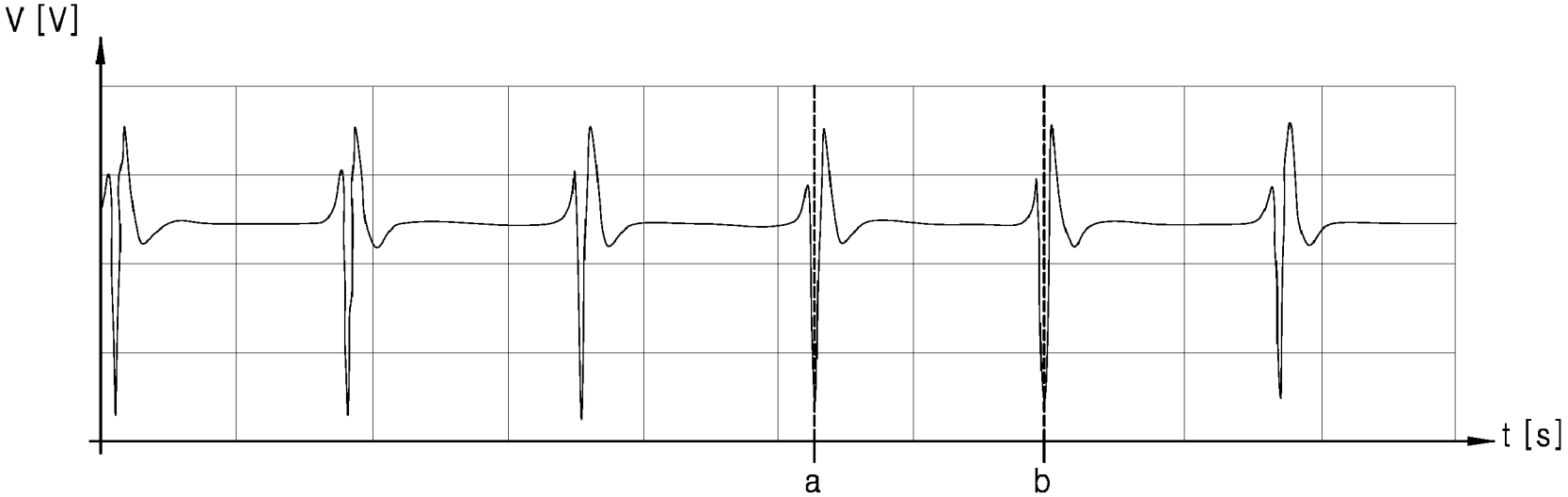
FIGS. 9 and 10 are graphs showing a voltage value generated in a coil based on the rotation of a nozzle provided in a dishwasher according to an embodiment of the present disclosure.
Figure 10:
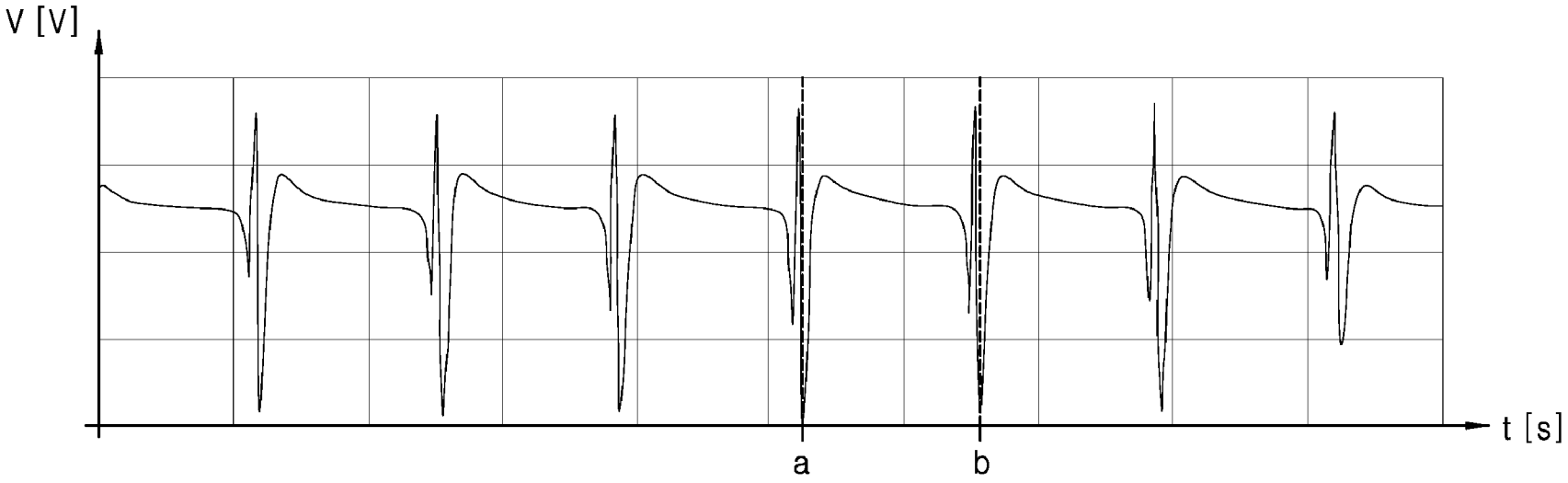

FIGS. 9 and 10 are graphs showing a voltage value generated in a coil based on the rotation of a nozzle provided in a dishwasher according to an embodiment of the present disclosure.

Referring to FIG. 9, a graph shows voltage values generated in the coil 230 and sensed by the controller 240 when the nozzle 220 rotates in a clockwise direction in the embodiment of the present disclosure. Referring to FIG. 10, a graph shows voltage values generated in the coil 230 and sensed by the controller 240 when the nozzle 220 rotates in a counter-clockwise direction.

Referring to FIGS. 9 and 10, whenever the nozzle 220 rotates and the magnetic material 221 passes a position adjacent to the coil 230, it can be seen that the magnitude of the change amount of the voltage value increases.

At this time, it is shown that when the nozzle 220 rotates in the clockwise direction, the voltage value first increases as the magnetic material 221 approaches. That is, the amount of change in the voltage value first has a positive value.

Conversely, when the nozzle 220 rotates in the counter-clockwise direction, the voltage value first decreases as the magnetic material 221 approaches. That is, the change amount of the voltage value first has a negative value.

The controller 240 may determine the rotation direction of the nozzle 220 by checking the change amount of the voltage value.

In addition, the controller 240 may calculate the interval between the times when the change amount of the voltage value increases, and may calculate the rotation speed of the nozzle 220 based on the calculated interval. As one example, the rotation speed of the nozzle 220 may be calculated based on the interval between a time point of 'a' and a time point of 'b' that are shown in FIGS. 9 and 10. That is, the controller 240 may calculate the rotation speed of the nozzle 220 by using that the nozzle 220 is rotated once from the time point of 'a' to the time point of 'b'.

Accordingly, the controller 240 may determine the rotation direction and the rotation speed of the nozzle 220 based on the change amount of the voltage values generated in the coil 230.

Referring back to FIG. 3, when the determined rotation direction of the nozzle 220 is different from a rotation direction included in the operation command, the controller 240 may transmit an abnormality notification to the user terminal or control the interface to output an abnormality notification. In addition, when the difference between the determined rotation speed of the nozzle and the rotation speed included in the operation command is a reference error or more, the controller 240 may transmit an abnormality notification to the user terminal or control the interface to output an abnormality notification. As the controller 240 outputs the abnormality notification in case of an abnormality of the nozzle 220, the user may respond and deal with the abnormality of the nozzle 220 more quickly.

As described above, when the dishwasher 200 according to the embodiment of the present disclosure is used, the operation state of the nozzle 220 may be determined based on the voltage value generated in the coil 230 formed to surround the area corresponding to the movable range of the nozzle 220. Accordingly, even when the position of the nozzle 220 is changed, it may be detected whether the nozzle 220 rotates. In addition, both the rotation direction and the rotation speed of the nozzle may be determined, thereby determining the operation state of the nozzle more accurately.

The embodiments are described above with reference to a number of illustrative embodiments thereof. However, the present disclosure is not intended to limit the embodiments and drawings set forth herein, and numerous other modifications and embodiments can be devised by one skilled in the art. Further, the effects and predictable effects based on the configurations in the disclosure are to be included within the range of the disclosure though not explicitly described in the description of the embodiments.

What is claimed is:

1. A dishwasher comprising:

a tub including a washing room configured to accommodate a washing target;

a door coupled to one surface of the tub, the door being configured to open and close the washing room;

a nozzle disposed in the washing room and configured to spray wash water to the washing target, the nozzle comprising a magnetic material;

a coil located adjacent to an area corresponding to a movable range of the nozzle, the coil being configured to generate an electric current therein as the nozzle rotates;

a securing bracket securing the coil to the door; and a controller configured to:

control operation of the nozzle based on an operation command, and determine an operational state of the nozzle based on a voltage value generated in the coil.

2. The dishwasher of claim 1, further comprising a rack disposed in the washing room, the rack being configured to accommodate the washing target, wherein the magnetic material has a magnetic force corresponding to a distance between the nozzle and the rack.

3. The dishwasher of claim 1, wherein the coil includes a wire wound around a structure.

4. The dishwasher of claim 1, wherein the coil is a patterned coil printed on a substrate.

5. The dishwasher of claim 1, further comprising a dispenser disposed in a predetermined portion of the door, the dispenser being configured to supply a washing detergent to the washing room.

6. The dishwasher of claim 1, further comprising an amplifier circuit configured to:

amplify the voltage value generated in the coil by using one or more operational amplifiers and one or more passive elements, and output the amplified voltage value to the controller.

7. The dishwasher of claim 1, wherein the controller is further configured to:

determine that the operational state of the nozzle is a stop state, in response to the voltage value generated in the coil being 0 volts, and determine that the operational state of the nozzle is a rotation state, in response to the voltage value generated in the coil being greater than 0 volts.

8. The dishwasher of claim 7, wherein the controller is further configured to transmit an abnormality notification to a user terminal or control an interface of the dishwasher to output the abnormality notification, in response to determining that the operational state of the nozzle is the stop state during a process of controlling the nozzle to rotate.

9. The dishwasher of claim 1, wherein the controller is further configured to determine a rotation direction and a rotation speed of the nozzle based on a change amount of voltage values generated in the coil.

10. The dishwasher of claim 1, wherein the controller is further configured to transmit an abnormality notification to a user terminal or control an interface of the dishwasher to output an abnormality notification, in response to determining that a rotation direction of the nozzle is different than a rotation direction included in the operation command or that a rotation speed of the nozzle is different than a rotation speed included in the operation command by at least a reference amount.

11. A dishwasher comprising:

a tub including a washing room configured to accommodate a first washing target;

a door coupled to one surface of the tub, the door being configured to open and close the washing room;

a first nozzle disposed in the washing room and configured to spray wash water to the washing target;

a coil located adjacent to the first nozzle, the coil being configured to generate an electric current therein as the first nozzle rotates;

a securing bracket securing the coil to the door; and a controller configured to determine an operational state of the first nozzle based on a voltage value generated in the coil due to the electric current flowing through the coil.

12. The dishwasher of claim 11, wherein the first nozzle includes a magnetic material, the magnetic material being configured to move as the first nozzle rotates, and wherein movement of the magnetic material alters a size of a magnetic field passing through the coil.

13. The dishwasher of claim 11, further comprising a first rack disposed in the tub, the first rack being configured to accommodate the first washing target, wherein the first nozzle includes a magnetic material, and wherein the magnetic material has a magnetic field corresponding to a distance between the first nozzle and the first rack.

14. The dishwasher of claim 13, wherein the first rack is movable in a vertical direction to accommodate the first washing target.

15. The dishwasher of claim 14, further comprising:

a second rack disposed below the first rack in the vertical direction, the second rack being configured to accommodate a second washing target; and a second nozzle configured to spray the wash water to the second washing target.

16. The dishwasher of claim 11, further comprising a dispenser disposed in the door, the dispenser being configured to supply a washing detergent to the washing room.

17. The dishwasher of claim 11, further comprising an amplifier circuit configured to:

amplify the voltage value generated in the coil by using one or more operational amplifiers and one or more passive elements, and output the amplified voltage value to the controller.

18. The dishwasher of claim 11, wherein the controller is further configured to:

determine that the operational state of the first nozzle is a stop state, in response to the voltage generated in the coil being 0 volts, and determine that the operational state of the first nozzle is a rotation state, in response to the voltage generated in the coil being greater than 0 volts.

19. The dishwasher of claim 18, further comprising an interface, wherein the controller is further configured to transmit an abnormality notification to a user terminal or control the interface to output the abnormality notification, in response to determining that the operational state of the first nozzle is the stop state during a process of controlling the first nozzle to rotate.

* * * * *